US006581746B1

(12) United States Patent
Lundblad

(10) Patent No.: US 6,581,746 B1
(45) Date of Patent: Jun. 24, 2003

(54) BANKNOTE HANDLING MACHINE

(75) Inventor: Leif Lundblad, Stockholm (SE)

(73) Assignee: Nybohov Development AB, Stockholm (SE)

( * ) Notice: Subject to any disclaimer, the term of this patent is extended or adjusted under 35 U.S.C. 154(b) by 0 days.

(21) Appl. No.: 09/719,161

(22) PCT Filed: Jun. 10, 1999

(86) PCT No.: PCT/SE99/01023

§ 371 (c)(1),
(2), (4) Date: Dec. 12, 2000

(87) PCT Pub. No.: WO99/67750

PCT Pub. Date: Dec. 29, 1999

(30) Foreign Application Priority Data

Jun. 12, 1998 (SE) ..... 9802096

(51) Int. Cl.[7] ..... G07F 7/04
(52) U.S. Cl. ..... 194/206; 235/379
(58) Field of Search ..... 194/206, 208, 194/209, 212, 215, 216, 217; 209/534; 405/40

(56) References Cited

U.S. PATENT DOCUMENTS

| | | | | | |
|---|---|---|---|---|---|
| 4,447,714 | A | | 5/1984 | Lundblad | 235/379 |
| 4,639,582 | A | | 1/1987 | Arikawa et al. | 235/379 |
| 4,825,378 | A | * | 4/1989 | Yuge | 209/534 |
| 5,000,322 | A | * | 3/1991 | Goi | 209/534 |
| 5,021,639 | A | * | 6/1991 | Hara et al. | 235/379 |
| 5,247,159 | A | * | 9/1993 | Yuge et al. | 209/534 |
| 5,468,941 | A | | 11/1995 | Sasaki | 235/379 |
| 5,522,511 | A | * | 6/1996 | Sakoguchi et al. | 209/534 |

FOREIGN PATENT DOCUMENTS

| | | | | |
|---|---|---|---|---|
| EP | 0 024 704 | | 3/1981 | G07D/1/00 |
| EP | 0 213 094 | | 3/1987 | G07F/7/10 |
| EP | 0 871 149 | | 10/1998 | G07D/11/00 |
| JP | 1-292593 A | * | 11/1989 | G07F/9/00 |
| JP | 4-275696 A | * | 10/1992 | G07D/9/00 |

* cited by examiner

*Primary Examiner*—Donald P. Walsh
*Assistant Examiner*—Mark J. Beauchaine
(74) *Attorney, Agent, or Firm*—Jacobson Holman PLLC

(57) ABSTRACT

A banknote handling machine having an infeed part for receiving externally posted banknotes and including a detector mechanism for checking the genuineness, quality and value of posted banknotes. The detector mechanism functions to sort false banknotes and banknotes of poor quality from remaining banknotes. A processor unit controls transportation of poor quality banknotes along a transport part to a unit for storing and packaging the banknotes, and the transportation of at least part of the remaining, genuine and accepted banknotes to a first storage unit for storing and packaging these banknotes in accordance with their denomination. An outfeed part enables banknotes ordered externally via a banknote ordering means to be dispensed from a second storage device. The processor unit controls the transportation of genuine and accepted banknotes primarily to the second storage device in the outfeed part and only secondarily to a first storage device in the infeed part.

6 Claims, 1 Drawing Sheet

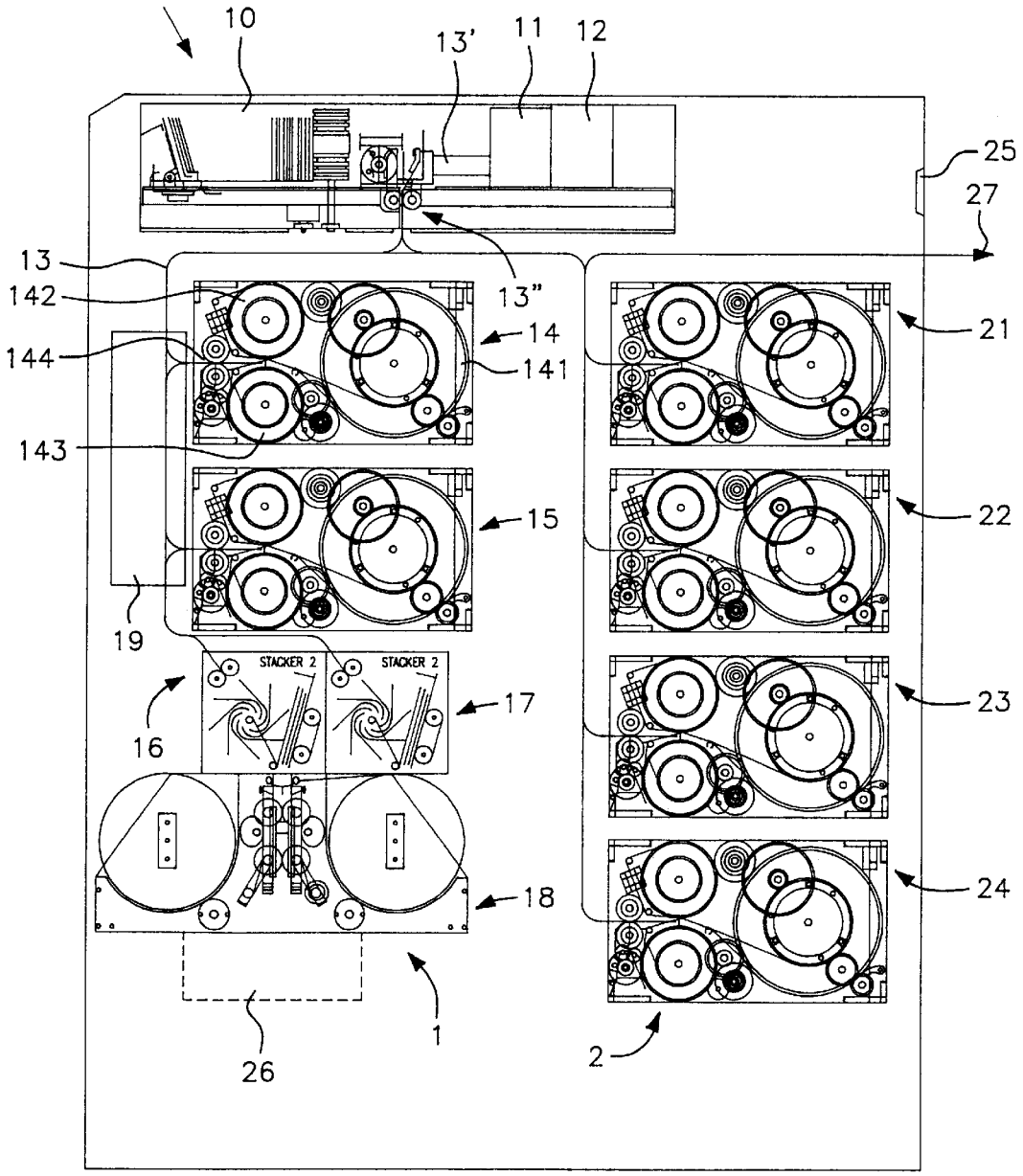
10
13'
11
12
25
27
13
142
13"
14
21
144
141
143
15
22
19
STACKER 2
STACKER 2
17
23
16
18
24
1
26
2

BANKNOTE HANDLING MACHINE

FIELD OF INVENTION

The present invention relates to a banknote handling machine, and more specifically to a machine that includes an infeed part for receiving banknotes that are posted from outside the machine and including detector means for checking the whether the banknotes are genuine or not, and the quality and denomination of said banknotes.

In a further development of the invention, the banknote handling machine also includes an outfeed part for dispensing banknotes from a banknote storage means in response to an order given through the medium of an externally located banknote ordering means.

BACKGROUND PRIOR ART

Dual-purpose automatic apparatus for dispensing and depositing banknotes are known to the art; c.f. U.S. Pat. No. 4,447,714 in this respect. It is also known to provide detection means for checking deposited banknotes; c.f. European Patent Specification 0.213.094 in this respect. These and similar automatic apparatus have been found to function reasonably well in practice, although they have their limitations with respect to greater freedom in the flow of banknotes, i.e. as opposed to shutting off excessively large volumes of banknotes in one and the same place (costs interest), the ability to replenish an automatic cash dispenser or automatic telling machine with banknotes during the daytime without opening the security box, and enhanced security with respect to the transportation of any surplus banknotes from one place to another place where a banknote deficiency exists.

The object of the present invention is to provide banknote handling machines that fulfil these requirements and desiderata and which generally simplify and make less expensive the flow of banknotes in the community, for instance by reducing the need of quality sorting, banknote authenticity checks and the need to count said banknotes prior to destruction (the National Central Bank). Another advantage is that banknotes handled through the novel machine can be circulated in the community without needing to be recounted when a bundle of banknotes in a disposable cassette changes owner.

SUMMARY OF THE INVENTION

The inventive banknote handling machine includes an infeed part for receiving externally posted banknotes. For the purpose of checking the genuineness and denominational value of posted banknotes the machine includes detector means for sorting false banknotes and banknotes of poor quality from other (accepted) banknotes. A processor unit controls the transport of banknotes of poor quality through the machine, along a transport path to a banknote packaging unit in which these banknotes are stored in a cassette means.

In a further development of the invention, the banknote handling machine also includes an outfeed part for dispensing banknotes from storage devices in response to an order entered externally through the medium of banknote ordering means. The processor unit controls the transportation of genuine and accepted banknotes directly to storage means in the dispenser part of the machine and only secondarily to storage means in the infeed part of said machine. Alternatively, the processor unit transports banknotes from storage means in the infeed part of the machine to storage means in the outfeed or dispensing part of said machine on the basis of the number of banknotes contained in this latter storage means.

These and other characteristic features of the invention will be apparent from the accompanying Claims.

DESCRIPTION OF PREFERRED EMBODIMENTS

The invention will now be described in more detail with reference to the accompanying drawing which illustrates schematically a banknote handling machine constructed in accordance with the invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The inventive banknote handling machine includes a banknote infeed part 1 and a banknote outfeed part 2.

The infeed part 1 includes a banknote depositing compartment 10, detector means 11, processing unit 12, transport path 13'-13"-13, first storage means 14, second storage means 15, first stacking means 16, second stacking means 17, and a banknote packaging unit 18.

A deposit is made by placing banknotes, e.g. a bundle of banknotes, possibly of mutually different denominations, in the infeed compartment 10, which can accommodate up to 500 banknotes. These banknotes are separated one by one and passed along an upper transport path 13', past the detector means 11 and up to guide means (direction changing means) 13", which leads the banknotes down to a lower transport path 13.

The detector means 11 is positioned close to the infeed compartment 10 and is designed to separate false banknotes, banknotes of poor quality and other banknotes. By separating is meant here a sorting process in which banknotes that pass the detecting means are "marked" in some appropriate way that will enable said banknotes to be handled as "false", "poor" or "accepted" banknotes during their subsequent transportation.

The storage means 14, similar to several other similar storage means in the machine, includes two belts between which banknotes are stored, a winding-up drum 141, and two unwinding drums 142 and 143. The leading edge of a banknote arriving at the storage means actuates a sensor 144 which, in response, starts-up three motors each of which functions to drive a respective drum 141–143. The banknote is drawn about 120 mm in between the belts, which are wound-up together on the winding-up drum 141, where there is sufficient space to accommodate about 500 banknotes. As the belts are wound onto the drum, banknote information is sent to the processor unit 12, so that an account can be kept of the sequence between the banknotes. Banknotes are taken from the storage means 14, by delivering to the motors impulses that cause the drums to rotate in an opposite direction.

A manipulator 19 is provided along the transport path close to the storage means 14, 15, for correcting the positions of those banknotes which may have been twisted or displaced laterally during transportation.

Each of the stacking means 16, 17 includes a stacker wheel which gathers mutually sequential banknotes in a storage compartment into a bundle. When the bundle contains a given number of banknotes, the bundle is clamped by a pair of arms and fed down to the so-called cassetting or packaging unit 18.

The cassetting or packaging unit 18 includes two reels of packaging material (plastic). The bundle of banknotes to be packaged is drawn down into a pocket comprised of two plastic lengths of mutually equal lengths and widths, one from each reel. The plastic lengths are pressed together around the bundle and welded together at their edges with the aid of Teflon® coated hotmelt wire. This known technique is described in more detail in U.S. Pat. No. 5,031,379.

The processor unit 12 controls transportation of banknotes of poor quality along the transport part 13 to units 16-18 for storing and packaging these banknotes. This unit is comprised of the stacker means 16 and the packaging unit 18.

The manner in which the processor unit 12 controls banknotes along different parts of the transport 13 to different destinations with the aid of path selectors, detectors and so on, is part of conventional technology and will not therefore be described in detail here.

In one further development of the invention, the banknote handling machine includes a,banknote dispensing part 2 of given design for dispensing banknotes ordered externally to the outfeed opening or dispenser opening 27 from storage means 21 via an order implementing means 25 (thus not from the processor unit 12). The processor unit 12 controls the transportation of genuine and accepted banknotes fed into the infeed part 1 primarily to the storage means 21 in the outfeed part 2 and only to storage means 14 or 15 in the infeed part 1 when the storage means in the outfeed part is full.

When necessary, the processor unit 12 controls transportation of banknotes from the storage means 14 in the infeed part 1 of the machine to storage means 21 in the outfeed or dispensing part of the machine on the basis of the number of banknotes present in said storage means 21.

The outfeed part 2 includes a number of storage means, namely the means 21, 22, 23, 24, each of which is intended to store banknotes of the same denomination, for instance the means 21 and 22 are intended to store banknotes of 100 SEK and the means 23 and 24 are intended to store banknotes of 500 SEK, depending on the demand that can be expected in view of past experience.

So-called small-change cash, i.e. banknotes of smaller denominational value, such as one-hundred notes of 20 SEK and fifty notes of 50 SEK, can be ordered either through the order means 25 for withdrawal in the outfeed opening 27 in the dispenser part 2, or via an outer packaging management centre in the infeed part 1 for later collection and distribution by a transport company. This facility also includes the possibility of ordering the delivery of banknotes from the storage means in the outfeed or dispensing part to the infeed part for storage and possible packaging therein. This enables the outfeed part of the machine to be emptied completely of banknotes if so desired.

False banknotes detected in the detector means 11 may either be returned directly via the transport part 13' to an outfeed compartment close to the deposit compartment 10, or transported. to, e.g., the stacking means 16 and from there to the packaging unit 18 where they are packaged together with an automatically printed receipt containing the number of banknotes, the date, etc., and information concerning the person who deposited the banknotes, e.g. through his/her account number. If so desired, the source of false banknotes can be looked for, which should have a certain preventative effect.

Generally speaking, the major part of the banknotes fed into the infeed part 1 and then accepted will be transported directly to the outfeed part 2, whereas surplus accepted banknotes will be stored in the infeed part 1 for later packaging in the packaging unit 18 in disposable cassettes if desired, these cassettes being collected in a space 26 beneath the packaging unit. The disposable cassettes will preferably accommodate one-hundred bundles of banknotes together with a receipt, the text of which is printed conveniently on the inner surface of the package or cassette immediately before commencing the packaging operation. This organisation of the mechanical function of the machine will greatly increase the capacity of the machine and result in much greater flexibility and more economic handling of banknotes than earlier known banknote handling apparatus.

Sorting of banknotes with respect to quality and with respect to banknotes that must be destroyed, simplifies machine handling and facilitates the work associated with the destruction of banknotes outside the machine (carried out under the management of the National Central Bank).

According to one further development of the invention, the machine is provided with a destruction unit in which banknotes are shredded or torn to pieces so as to render them useless. Destruction of the banknotes can be effected inside the machine under safe electronic control steered by the processor unit. The detector means may also be designed to read the numbers carried by the banknotes, so as to obtain continuously information as to which banknotes have been destroyed and the total value of these banknotes on each occasion.

The significant possibilities afforded by the novel machine in de-centralising banknote handling procedures will be evident from the following summary.

A plurality of machines can be controlled over parts of a country or over the whole of the country, by a Co-operative centre and via an electronic network, for instance Internet. Banks, stores, shops and other bodies that require money report this requirement to the Co-operative centre, which is in constant contact with security vehicles that geographically circulate within the area as necessary. The Co-operative centre is in receipt of statistics that show the requirement of banknotes and the flow of money concerned and are therefore well aware of the money that will be required for each machine. Ordered emptying of surplus banknotes by packaging can therefore be effected from the infeed and outfeed part (module) of respective machines. When necessary, the outfeed part of a machine can be filled with banknotes from its infeed part, where banknotes are stored, or alternatively externally when it is necessary to open the machine. Disposable cassettes containing banknotes and collected from machines are delivered to those machines that have asked for banknotes and are located in a bank or in a shop or store, or in an automatic banknote dispensing machine. Because the banknotes are delivered in closed and sealed disposable cassettes, counting of loose banknotes is obviated.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A banknote handling machine comprising:

an infeed part for receiving externally posted banknotes;

detector means for controlling the genuineness, quality and denominational value of the posted banknotes, said detector means designed to sort-out false banknotes, banknotes of poor quality and other banknotes;

a processor unit designed to control transportation of the poor quality banknotes along a transport path to a banknote storing and packaging unit, and to control transportation of at least a part of the remaining, genuine and accepted banknotes to a first storage unit for storing and packaging said banknotes in accordance with their value; and an outfeed part for dispensing from second storage means banknotes ordered externally via a banknote order means;

said processor unit controlling transportation of banknotes from said first storage means in the infeed part to said second storage means in the outfeed part in accordance with a number of banknotes contained in said second storage means.

2. The banknote handling machine according to claim 1, wherein the processor unit is designed to control transportation of genuine and accepted banknotes primarily to the second storage means in the outfeed part and secondarily to the first storage means in the infeed part.

3. The banknote handling machine according to claim 1, wherein the infeed part includes at least two banknote storage means, two banknote collecting and stacking means, and a banknote packaging means, said processor unit controlling transportation of poor quality banknotes from the detector means directly to one of said banknote collecting and stacking means and from there to the packaging means, and controlling transportation of at least part of the remaining, accepted banknotes to one of said storage means and from there to the remaining banknote collecting and stacking means and banknote packaging means.

4. A banknote handling machine comprising:

an infeed part for receiving externally posted banknotes, said infeed part including first and second banknote storage means, first and second banknote collecting and stacking means, and a banknote packaging means;

detector means for controlling the genuineness, quality and denominational value of the posted banknotes, said detector means designed to sort-out false banknotes, banknotes of poor quality and other banknotes; and a processor unit designed to control transportation of the poor quality banknotes along a transport path from said detector means to said first banknote collecting and stacking unit and from there to said banknote packaging means, and to control transportation of at least a part of the remaining, genuine and accepted banknotes to said first storage unit and from there to the second banknote collecting and stacking means and said banknote packaging means for storing and packaging said banknotes in accordance with their value.

5. The banknote handling machine according to claim 4, further comprising:

an outfeed part for dispensing from second storage means banknotes ordered externally via a banknote order means;

said processor unit controlling transportation of banknotes from said first storage means in the infeed part to said second storage means in the outfeed part in accordance with a number of banknotes contained in said second storage means.

6. The banknote handling machine according to claim 5, wherein the processor unit is designed to control transportation of genuine and accepted banknotes primarily to the second storage means in the outfeed part and secondarily to the first storage means in the infeed part.

* * * * *